US005971727A

United States Patent [19]

Horan et al.

[11] Patent Number: 5,971,727

[45] Date of Patent: Oct. 26, 1999

[54] HIGH-PRESSURE HYDRAULIC PUMP WITH IMPROVED PERFORMANCE

[75] Inventors: Gerald P. Horan; Philip M. Carlton, both of Pickering, Canada

[73] Assignee: Chart Industries Ltd., Pickering, Canada

[21] Appl. No.: 09/045,846

[22] Filed: Mar. 23, 1998

[51] Int. Cl.[6] ..... F04B 7/04

[52] U.S. Cl. ..... 417/489; 417/307; 417/407

[58] Field of Search ..... 417/489, 392, 417/407, 307; 60/477

[56] References Cited

U.S. PATENT DOCUMENTS

| | | | |
|---|---|---|---|
| 3,802,805 | 4/1974 | Roeser | 417/489 X |
| 4,053,902 | 10/1977 | Skafvenstedt et al. | 417/489 X |
| 4,735,595 | 4/1988 | Gaiser | 417/307 X |
| 5,050,482 | 9/1991 | Yonezawa et al. | 417/392 X |
| 5,800,136 | 9/1998 | Kurth et al. | 417/307 X |

*Primary Examiner*—Hoang Nguyen

*Attorney, Agent, or Firm*—Neil H. Hughes; Ivor M. Hughes; Marcelo K. Sarkis

[57] ABSTRACT

The present pump design with the elimination of a separate hydraulic fluid path from the cylinder dramatically improves the efficiency and pressure achieved by the pump by 15% as a result of reducing the number of chambers provided in the pump interior. It is, however, imperative for reasons not completely understood that in order for these efficiencies to be obtained that a reservoir of oil be located adjacent the main oil intake volume to ensure quick filling of the main oil intake volume as the piston cycles to its pressure stroke. This prevents cavitation of the pump.

1 Claim, 6 Drawing Sheets

HIGH-PRESSURE HYDRAULIC PUMP WITH IMPROVED PERFORMANCE

FIELD OF INVENTION

The present invention relates to fluid pumps and particularly to those embodied in a working module.

BACKGROUND OF THE INVENTION

Fluid pumps, particularly hydraulic oil pumps for actuating vehicle repair equipment are well known. The hydraulic pumping unit of the present invention is designed to provide a unit of greater efficiency in operation when driven by conventional mechanisms such as air motors and electric motors or the like. A dependable unit therefore is provided having a reduced cost and improved efficiencies as a result of a relatively simple design wherein some of the parts provide multiple functions.

It is well known to provide a working module including a pump driven by an air motor or an electric motor. Examples exist in the prior art of such devices. One such device manufactured by Chart Industries is illustrated in FIG. 1 and includes a pump having inlet ports for hydraulic oil and outlet ports. The inlet ports provide a path for oil to enter the valve from a hydraulic fluid reservoir through a dedicated inlet port having a ball check valve located therein to allow hydraulic fluid to enter but not exit the pump during the intake stroke of the two-cycle pump. The pump is driven by an air motor which includes a piston driven by compressed air to drive the piston from top-dead center which is defined in this case adjacent the end of the pump near the hydraulic fluid reservoir to bottom-dead center remote that end. As the intake stroke begins, oil enters the pump through the dedicated inlet port drawing oil into the pump until such time as the piston reaches bottom-dead center and is pushed by the air motor as dictated by the operator as the appropriate switch is operated to drive the piston toward top-dead center compressing the oil and having the oil pass through the outlet port toward a hydraulic cylinder to be utilized, for example, to straighten the frame of an automobile. This is not part of the invention and will not be discussed any further. The air motor may be substituted by an electric motor as is well known in the art. The operation of the air motor is not discussed any further except to define it as a reciprocating air motor to drive the hydraulic piston between top-dead center and bottom-dead center. Once the work is completed by the remote hydraulic cylinder, it is necessary to return the fluid to the hydraulic reservoir and allow the hydraulic cylinder to return to its inoperative position. To do so, a separate air-operated valve is required which drives a piston forward as dictated by the operation of another control by the operator to lift the check from its seat in an opposite direction from the check's normal use and to allow hydraulic fluid to flow back into the pump and then back into the hydraulic fluid reservoir through a separate release mechanism and port.

Such an operation is therefore required of the pump having dedicated return lines and inlet ports as well as return ports are necessary. With such a pump, pressures in the order of 10,000 psi at the outlet may be generated. However, the costs of manufacturing required to produce such a pump are relatively high in that the pump must be manufactured of operable components which are ultimately assembled. This prior art pump manufactured by Chart Industries at the present time has dedicated ports each of which require a predetermined amount of space-defining channels. These dedicated channels or ports create the disadvantage of pockets of turbulence when the reciprocal piston moves between the pressure stroke and the intake stroke. The intake port interferes with the build up of pressure at top-dead center position and inhibits the capability of the pump to generate higher pressures. Further, if oil is not made quickly available to the pump at these higher pressures, cavitation will result.

Nowhere within the prior art is there found a pump design which eliminates the need for dedicated ports and the associated check valves provided therewith and provides a pump construction that utilizes an existing channel and port in multiple-use fashion allowing hydraulic fluid to enter the pump without a check on that particular intake function and which in the elimination of an intake check and port and hoses required, elbows and the like, thereby would reduce the pressure drop across that port. Further, it would be advantageous to provide flow back to the hydraulic fluid reservoir from an operating unit such as a cylinder. It would be advantageous to provide the fluid flowing back through an outlet port and through chambers within the port construction of the valve including a ring chamber adjacent to the inlet port for allowing fluid to flow back to the hydraulic reservoir from the cylinder through the ring-shaped chamber and the inlet port as the piston moves to bottom-dead center closest to an air motor.

It is therefore a primary object of the invention to provide a high-pressure two-cycle hydraulic pump which is cost effective to manufacture and easy to manufacture.

It is a further object of the invention to provide a high-pressure hydraulic two-cycle pump made from a solid cylinder of metal which is easily machined to provide all necessary ports therein.

It is a further object of the invention to improve the efficiency in high-pressure hydraulic two-cycle pumps by simplifying the construction thereof.

It is a further object of the invention to provide such a high-pressure pump assembly embodied in a working module utilized to straighten frames of vehicles.

Further and other objects of the invention will become apparent to those skilled in the art when considering the following summary of the invention and the more detailed description of the preferred embodiments illustrated herein.

SUMMARY OF THE INVENTION

According to a primary aspect of the invention there is provided a hydraulic pump comprising:

a housing made from a solid metal cylindrical body having two ends and a circumference, said housing having formed therewith proximate one end thereof a first opening of predetermined diameter having two ends, and extending toward the center of said body, one end of said opening terminating proximate a mouth adjacent the end of said body and having a first diameter having two ends and the other end of said opening terminating within the interior of said body and providing a bottom thereat having a second diameter smaller than the first diameter of said opening, said housing having disposed proximate the circumference thereof two preferably aligned second and third openings each having two ends and terminating proximate the bottom of said first opening, the ends of said second and third openings proximate said circumference of said body having a larger diameter than the diameter of said second and third openings proximate the bottom of said first opening, said larger diameter of said second and third openings having two ends, one end disposed proximate the circumference of the body and the other end terminating proximate the reduced diameters of said second and third openings, said first opening having disposed therein, adjacent the terminus of its larger diameter intermediate the mouth and the bottom of the first opening; a ring-shaped opening having a first and second diameter and a top and a bottom, said top of said ring-shaped opening being disposed adjacent the interior end of said first diameter of said first opening, the second end of said body remote said first opening having formed therein a hydraulic oil inlet port extending from adjacent the circumference of the second end and terminating adjacent the bottom of said ring;

a first threaded fitting for closing the mouth of said first opening;

a second threaded fitting for closing the second opening;

a third threaded fitting for closing the third opening;

a check valve for seating within the second opening and for free movement in a direction away from said bottom of said first opening;

a piston assembly for insertion with said first opening prior to positioning the first fitting, said piston assembly being in communication with a separate motor assembly and for reciprocal movement of said piston between the limits of a pressure stroke and an intake stroke within said first opening between the ends thereof, a hydraulic oil release assembly for insertion with said third opening prior to closing the third opening with the third fitting, said release assembly for reciprocal movement with said third opening between the ends thereof and having a check engaging head proximate one end thereof, said release assembly being in communication with a source of compressed air in use and being moveable by said compressed air between an exhaust position and an operating position whereat said lever of said release mechanism moves said check valve away from its seat to provide reverse flow of hydraulic oil by said check valve toward said bottom of said first opening when said piston is located at the full limit of its intake stroke, whereat said hydraulic oil is able to flow back through said hydraulic oil inlet port, wherein said second opening containing said check allows for the pumping of hydraulic fluid to a hydraulic cylinder for the operation thereof and said third opening allows for the reversal of hydraulic fluid through the second opening by the operation of the release mechanism to move said check from its seat and allow hydraulic oil to pass to a storage reservoir from said ring-shaped opening disposed with the first opening when the piston is at the limit of its intake stroke, and wherein when said piston moves from the limit of its intake stroke to begin its pressure stroke as motivated by said motor, hydraulic oil will be drawn from an oil reservoir through said inlet port to said ring-shaped opening and along said reduced diameter of said first opening to the bottom thereof and out the second opening to the hydraulic cylinder with a reduction in cavitation of said pump as a result of the reduction in the number of chambers therein.

The present pump design with the elimination of a separate hydraulic fluid path from the cylinder dramatically improves the efficiency and pressure achieved by the pump by 15% as a result of reducing the number of chambers provided in the pump interior. It is, however, imperative for reasons not completely understood that in order for these efficiencies to be obtained that a reservoir of oil be located adjacent the main oil intake volume to ensure quick filling of the main oil intake volume as the piston cycles to its pressure stroke. This prevents cavitation of the pump.

DETAILED DESCRIPTION OF THE PREFERRED EMBODIMENTS

Figure 1:
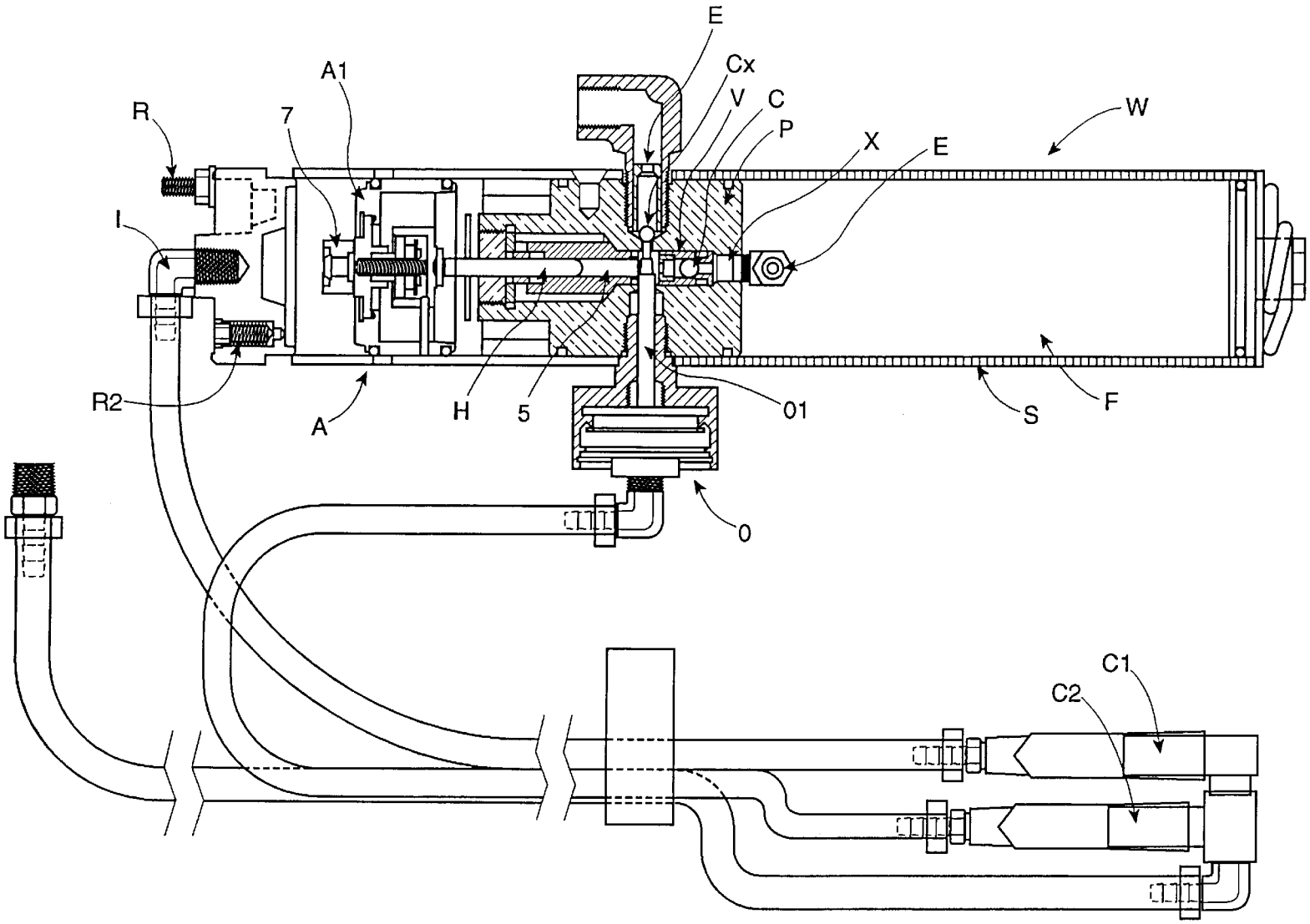
Figure 1 (PRIOR ART)
FIG. 1 is a schematic view of a prior art construction manufactured by the assignee.

Referring generally to FIG. 1, there is illustrated a prior construction manufactured by Chart Industries utilized for the straightening of frames for automobiles or the like. The working module W includes a hydraulic fluid reservoir F contained within a shell S. The fluid reservoir F is connected to a pump P via an elbow E, a filter screen X and an intake valve body V having a check C located therein. The inlet valve V is in line with the piston cylinder 5 to allow oil to pass from the fluid reservoir F into the cylinder 5 when the piston H moves in its intake stroke from adjacent the inlet valve V to the other end of the shell S where an air motor A is contained. The air motor includes a piston A1 which moves reciprocally between adjacent the air inlet I where compressed air is inlet when an operator operates the control C1 to allow compressed air to enter into the air motor and move the piston A1 in a direction toward the fluid reservoir F. Alternatively, when an exhaust stroke is called for as defined by the regulating adjusting pins R1 and R2 and the operation of the valve piston 7 will allow the air piston to move to the end of the shell remote the fluid reservoir F. With the piston H being attached to the air motor, it moves to the left of the figure to the bottom of its stroke drawing in fluid through the inlet port X through valve V through check C. When the piston H reaches bottom-dead center, it will then begin its pressure stroke and move the piston H toward the outlet or exhaust port at E also having a check valve Cx utilized to return fluid to the pump and to the reservoir. There is also a dedicated outlet port (not shown) when the piston H moves in its pressure stroke to pump the fluid from the pump P to the hydraulic cylinder which is remote the working module unit. The function of this unit is well known. It has a ratio of approximately 100 to 1 generating up to 10,000 psi at the outlet by the piston combined with the air cylinder. Thus, the high-pressure one-way single acting pump is provided. However, manufacturing such a pump requires a considerable amount of skill in manufacturing techniques. Three check valves are required; one on the inlet, one on the return and one on the outlet ports. The provision of such a large number of ports therefore requires the careful machining of the seat for each of the three checks. As well, an air-operated piston unit O is provided wherein when the operator operates the control C2 for example, the piston O1 will move forward moving the check C from its seat and allowing the hydraulic fluid to return into the pump and hence to the reservoir through a complicated arrangement of channels. The pump therefore has a maximum capacity which is limited because of the amount of back pressure produced by the number of dedicated ports and channels required in the construction of this pump. It would be advantageous to eliminate this back pressure and potential for cavitation at high-operating pressures.

Figure 2:
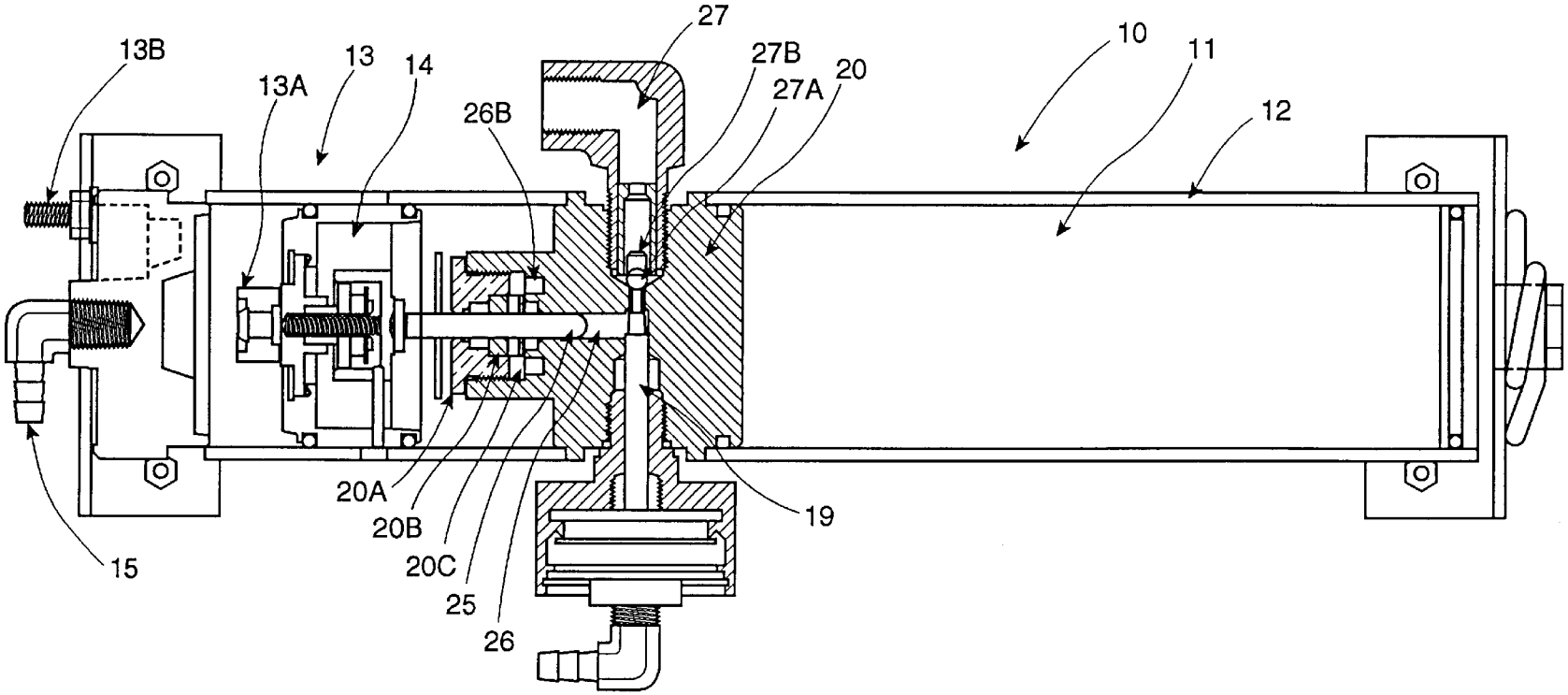
FIG. 2 is a schematic view of the working module of the present invention illustrated in a preferred embodiment thereof.
Figure 3:
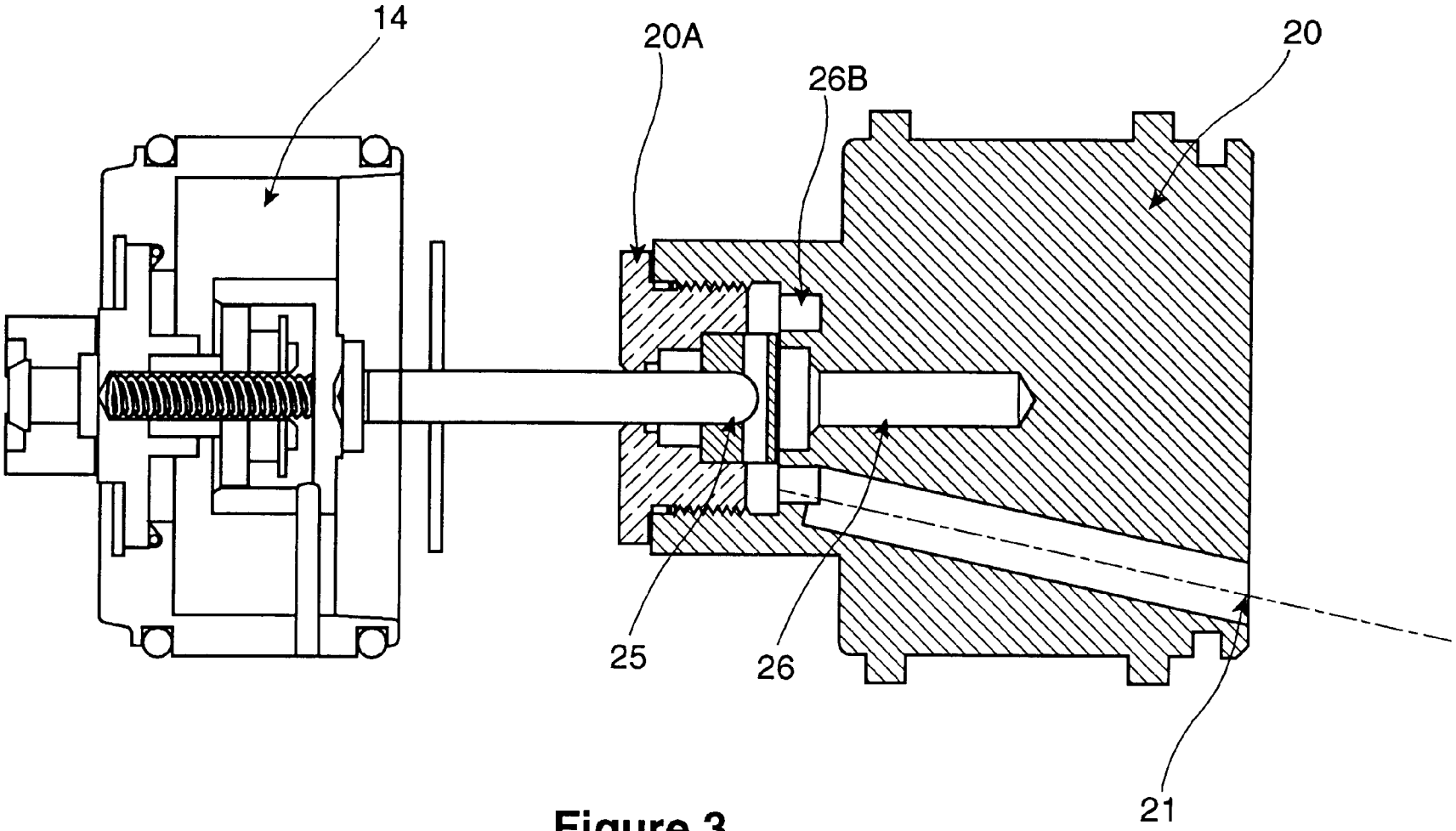
FIG. 3 is a schematic view of the pump embodying the present invention illustrating some of the components thereof in a preferred embodiment of the invention.

Referring now to FIG. 2 there is provided a working module unit 10 having a hydraulic fluid reservoir 11 contained within a housing which connects with a pump 20 connected also with an air-driven piston motor 13 having a reciprocating piston 14 located therein which moves via a compressed air source 15 in reciprocal fashion as was described in relation to the prior art structure of FIG. 1. The air piston 14 is attached to a piston 25 contained within a chamber 26 of the pump 20. The pump 20 has provided therein adjacent the chamber 26 a ring chamber 26*b* in communication with an inlet port as best seen in FIG. 3 which will be described hereinafter. A threaded retainer 20*a* and seals 20*b* and 20*c* are located adjacent the piston 25 attached to the air motor 14. The fluid therefore is pumped by the piston 25 through an outlet port 27 having a check valve 27*a* located therein seated within check seat 27*b*. On the pressure stroke when the piston moves from the bottom-dead center position to the top-dead center position, the hydraulic fluid will be pumped out the port 26*b* to a hydraulic cylinder in communication with the working module unit 10. A source of compressed air is also in communication with the release valve 19 in communication with a source of compressed air at 16. When the operator desires therefore, the check valve 25 can be raised when the piston 27*a* is at bottom-dead center adjacent the air motor compartment 13 to allow for the flow of hydraulic fluid from the remote hydraulic cylinder through the outlet port 27 into the chamber 26 to the ring chamber 26*b* and back into the inlet port 21 to the hydraulic fluid reservoir 11. An exhaust valve 13*a* is provided along with a regulator 13*b* to allow reciprocal movement of the piston 14 toward and away from the source of compressed air supply 15. As this happens, the piston 25 of the pump 20 also moves between bottom-dead center and top-dead center between intake and pressure strokes. The pump 20 as best seen in FIG. 3 is manufactured from a solid cylindrical piece of metal on a lathe with the various ports being drilled at the positions indicated.

Figure 4:
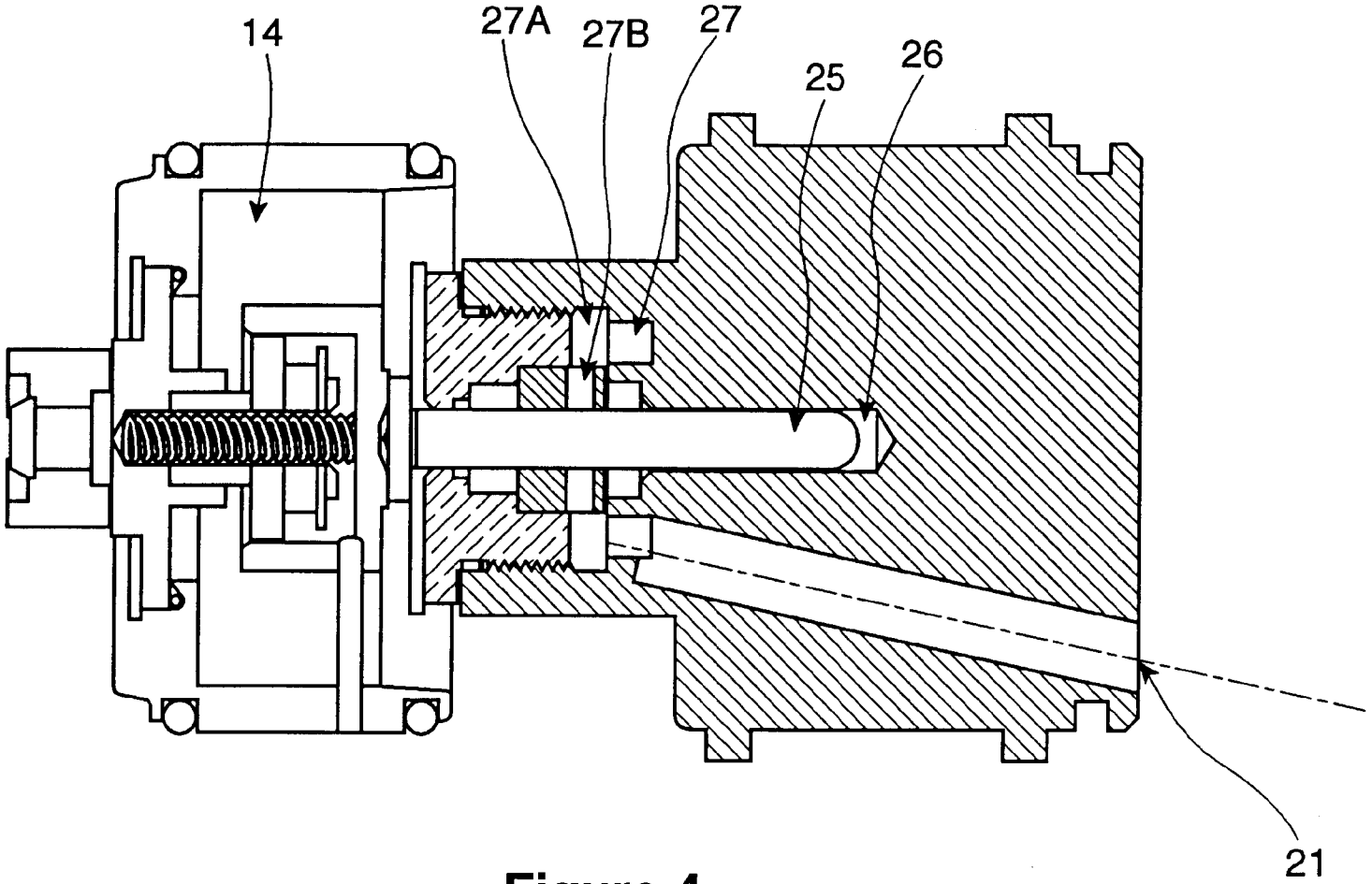
FIG. 4 is a view similar to FIG. 3 with the exception that the pump is at bottom-dead center and illustrated in a preferred embodiment of the invention.
Figure 5:
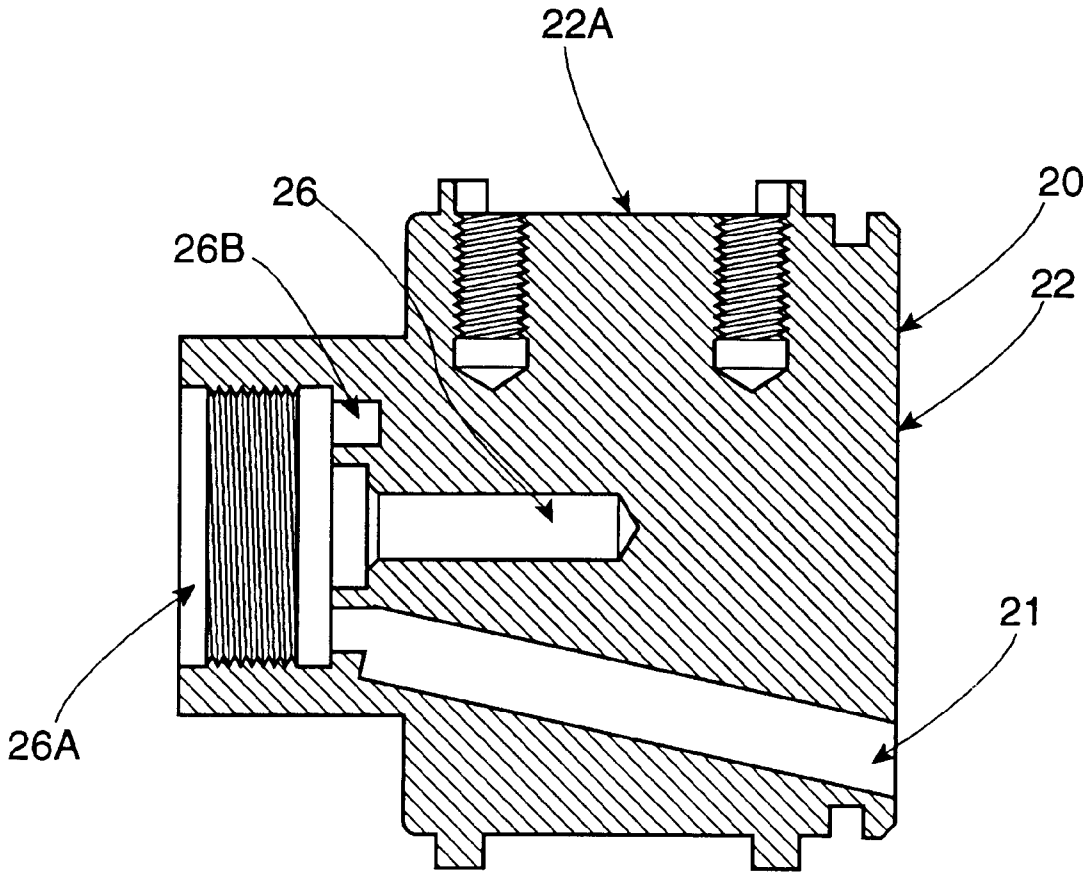
FIG. 5 is a view similar to that of FIG. 3 illustrating the housing only for the pump focusing on the intake ports thereof and illustrated in a preferred embodiment of the invention.

The pump 20 as best seen in FIG. 3 has an inlet port 21 drilled in the one-piece pump 20 at the indicated angle so as to be in communication at one end of the fluid reservoir 11 and to be in communication at the other end to the ring chamber 26*b* adjacent the main fluid chamber 26 for the piston 25. As the piston 25 therefore moves from its top-dead center position as seen in FIG. 4 to its bottom-dead center position as seen in FIG. 25, oil will enter the inlet port 21 into the ring chamber having a predetermined volume and through the channel 27 toward the chamber 26 filling the chamber with hydraulic fluid. It has been our experience that little turbulent flow results as a result of such an intake stroke. Once the piston 25 therefore moves toward top-dead center, the piston has the hydraulic fluid in intimate relation thereof and as it pushes the oil forward, oil will be drawn into the chamber 26 through the ring chamber 27 from the inlet 21 until such time as the piston moves past the port adjacent seat 27*b* preventing any further hydraulic oil from entering the chamber which on continued operation of the pressure stroke of piston 25 will cause the oil to exit through outlet 27 to the hydraulic cylinder which is located remote the working module unit 10 causing the hydraulic cylinder to extend in the conventional manner. The part adjacent the seat 27*b* are covered as the piston advances preventing any further flow of oil into the pump piston chamber 26, but providing for fullflow communication up until that port adjacent to seat 27*b* is covered. When an operator therefore wishes to close the remote hydraulic cylinder, a separate air actuated device 19 moves the check 27*a* off of its seat 27*b* to allow return flow of the hydraulic fluid to the fluid reservoir 11 only when the piston 25 is in the position shown in FIG. 3 allowing hydraulic fluid to pass through the chamber 26 back through the ports 27*b*, 27*a* and into the ring chamber 27 in communication with the inlet port 21 back to the fluid reservoir 11. A threaded cap 20*a* therefore closes and retains the piston in its proper position.

Figure 6:
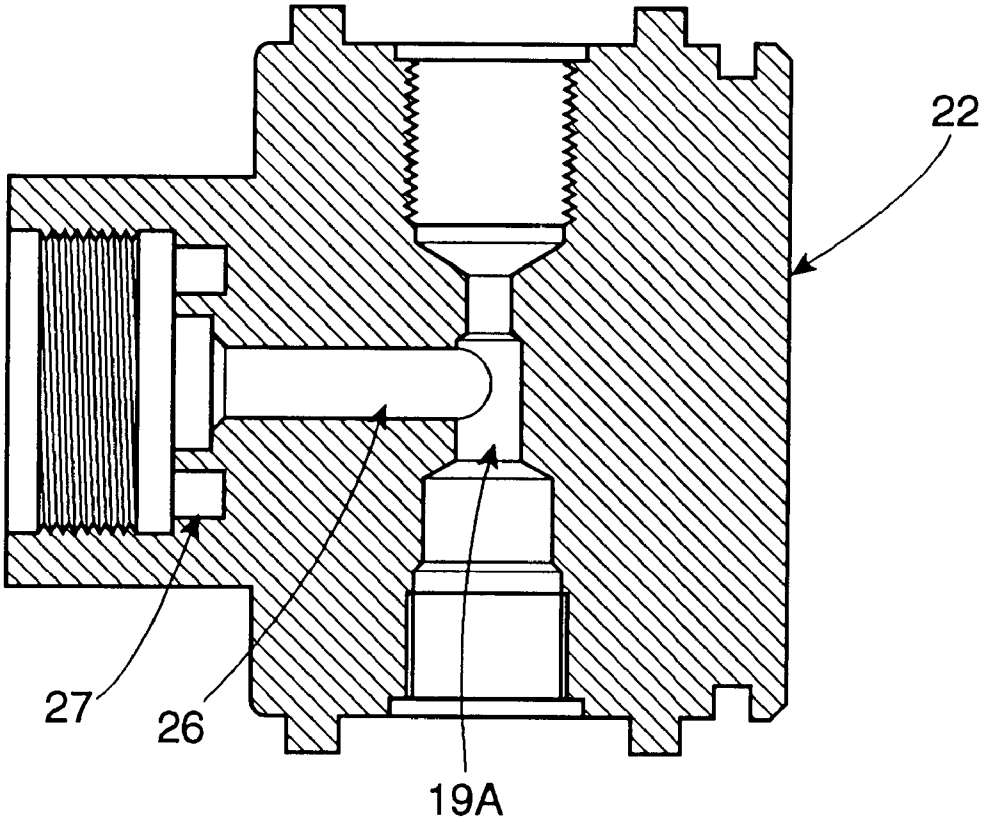
FIG. 6 is a cross-sectional view of the pump housing of FIG. 5 shown at 90° to the illustration of FIG. 5 and illustrated in a preferred embodiment of the invention.

In order therefore to manufacture the pump to be assembled with the working module unit 10, a solid cylindrical pump housing 22 is therefore provided and machined utilizing a lathe to form its contoured exterior at 22*a* to allow interfitting with the working module unit 10 as best seen in FIG. 2. The details of the perimeter therefore are not being discussed at this juncture. The chamber 26 therefore is formed utilizing a drill as is the inlet port 21. The chamber 26 is in communication with the ring chamber 27 which is also formed by machining of the opening 26 for receipt of the cap unit 20*a*. Referring to FIG. 6, the exhaust port has the check valve seat drilled out as does the release port 19*a* also in communication with the chamber 26. The entire pump 20 therefore is machined out from a solid piece of metal and then is assembled as is best seen in FIG. 2 with a considerably reduced amount of parts and check valves thereby allowing simplification of a high-pressure two-cycle pump reaching pressures of 11,500 psi which indicates an improved efficiency of 15% over the previous pump structure. A third valve therefore being the return valve is eliminated along with all of the cross-drilling required. The one-piece housing of the present invention is manufactured on a lathe, all of the ports are drilled out and tapped.

There is therefore the elimination of all of the other components described in relation to Figure which results in a considerable reduction in the amount of dedicated ports which create pockets of turbulence and affect the overall efficiency of the prior art pump structure. By eliminating the dedicated ports especially for the return circuit in the present pump, superior pressures can be achieved, turbulence has been minimized, the costs of manufacturing of the pump is reduced and simplified as indicated above, and a return path through the pump has been defined when the piston 19 is operated and the piston is at bottom-dead center. The hydraulic fluid will flow back through the outlet utilized in this multiple use fashion and return to the ring-shaped chamber and then hence to the fluid reservoir. This all happens under the control of the operator utilizing the correct buttons to activate the air motor or the release valve when required.

For simplicity sake, not all components have been illustrated or described. The essence of the invention has been described in sufficient detail to enable those skilled in the art to make use of the present invention.

As many changes can be made to the invention without departing from the scope of the invention, it is intended that all material contained herein be interpreted as illustrative of the invention and not in a limiting sense.

The embodiments of the invention in which an exclusive property or privilege is claimed are as follows:

1. A hydraulic pump comprising:

a housing made from a solid metal cylindrical body having two ends and a circumference, said housing having formed therewith proximate one end thereof a first opening of predetermined diameter having two ends, and extending toward the center of said body, one end of said opening terminating proximate a mouth adjacent the end of said body and having a first diameter having two ends and the other end of said opening terminating within the interior of said body and providing a bottom thereat having a second diameter smaller than the first diameter of said opening, said housing having disposed proximate the circumference thereof two preferably aligned second and third openings each having two ends and terminating proximate the bottom of said first opening, the ends of said second and third openings proximate said circumference of said body having a larger diameter than the diameter of said second and third openings proximate the bottom of said first opening, said larger diameter of said second and third openings having two ends, one end disposed proximate the circumference of the body and the other end terminating proximate the reduced diameters of said second and third openings, said first opening having disposed therein, adjacent the terminus of its larger diameter intermediate the mouth and the bottom of the first opening; a ring-shaped opening having a first and second diameter and a top and a bottom, said top of said ring-shaped opening being disposed adjacent the interior end of said first diameter of said first opening, the second end of said body remote said first opening having formed therein a hydraulic oil inlet port extending from adjacent the circumference of the second end and terminating adjacent the bottom of said ring;

a first threaded fitting for closing the mouth of said first opening;

a second threaded fitting for closing the second opening;

a third threaded fitting for closing the third opening;

a check valve for seating within the second opening and for free movement in a direction away from said bottom of said first opening;

a piston assembly for insertion with said first opening prior to positioning the first fitting, said piston assembly being in communication with a separate motor assembly and for reciprocal movement of said piston between the limits of a pressure stroke and an intake stroke within said first opening between the ends thereof, a hydraulic oil release assembly for insertion with said third opening prior to closing the third opening with the third fitting, said release assembly for reciprocal movement with said third opening between the ends thereof and having a check engaging head proximate one end thereof, said release assembly being in communication with a source of compressed air in use and being moveable by said compressed air between an exhaust position and an operating position whereat said lever of said release mechanism moves said check valve away from its seat to provide reverse flow of hydraulic oil by said check valve toward said bottom of said first opening when said piston is located at the full limit of its intake stroke, whereat said hydraulic oil is able to flow back through said hydraulic oil inlet port, wherein said second opening containing said check allows for the pumping of hydraulic fluid to a hydraulic cylinder for the operation thereof and said third opening allows for the reversal of hydraulic fluid through the second opening by the operation of the release mechanism to move said check from its seat and allow hydraulic oil to pass to a storage reservoir from said ring-shaped opening disposed with the first opening when the piston is at the limit of its intake stroke, and wherein when said piston moves from the limit of its intake stroke to begin its pressure stroke as motivated by said motor, hydraulic oil will be drawn from an oil reservoir through said inlet port to said ring-shaped opening and along said reduced diameter of said first opening to the bottom thereof and out the second opening to the hydraulic cylinder with a reduction in cavitation of said pump as a result of the reduction in the number of chambers therein.

* * * * *